United States Patent [19]

Piber et al.

[11] Patent Number: 5,071,423

[45] Date of Patent: Dec. 10, 1991

[54] EPILATION APPARATUS

[75] Inventors: Herbert Piber, Ferlach; Norbert Schneider, Ebental, both of Austria

[73] Assignee: U.S. Philips Corp., New York, N.Y.

[21] Appl. No.: 531,973

[22] Filed: Jun. 1, 1990

[30] Foreign Application Priority Data

Jun. 12, 1989 [AT] Austria ..... 1437/89

[51] Int. Cl.[5] ..... A45D 26/00

[52] U.S. Cl. ..... 606/133; 606/131; 606/36

[58] Field of Search ..... 606/36, 37, 39, 40, 606/43, 45, 131, 133; 30/34.05, 34.1, 34.2, 39, 51, 74.1, 77, 55, 59, 82, 90

[56] References Cited

U.S. PATENT DOCUMENTS

| | | | |
|---|---|---|---|
| 344,115 | 6/1886 | Kampfe | 30/34.2 |
| 2,413,576 | 11/1944 | Orner | 606/133 |
| 2,440,586 | 4/1948 | Jost | 30/34.2 |
| 3,421,215 | 1/1969 | Bauer | 30/34.1 |
| 4,830,004 | 5/1989 | Alazet | 606/133 |
| 4,901,723 | 2/1990 | Platek | 606/133 |
| 4,917,678 | 4/1990 | Locke et al. | 606/133 |
| 4,923,463 | 5/1990 | Nussbaum | 606/133 |

FOREIGN PATENT DOCUMENTS

| | | | |
|---|---|---|---|
| 0147285 | 7/1985 | European Pat. Off. | 606/133 |
| 2307491 | 12/1976 | France . | |
| 2586538 | 3/1987 | France | 606/133 |
| 2020548 | 11/1979 | United Kingdom | 606/133 |

*Primary Examiner*—Stephen C. Pellegrino
*Assistant Examiner*—Glenn K. Dawson
*Attorney, Agent, or Firm*—Ernestine C. Bartlett

[57] ABSTRACT

An epilation apparatus is provided having at least one pair of rotatably mounted epilation rollers (3, 4), which are arranged in the region of an opening (2) provided in the housing (1) of the apparatus, are rotatingly drivable in opposite directions and cooperate with one another at their periphery. Associated with the epilation apparatus is a skin protection device, which is arranged in the region of the opening (2), partially covering the epilation rollers (3, 4) and through which the hairs reach the epilation rollers (3, 4) the skin protection device is a strip-shaped web (11) of wave-shaped design in relation to the longitudinal extension of the epilation rollers, (3, 4) the web, has wave troughs (9) and wave crests (10) alternately on both sides and is comb-like on both sides.

9 Claims, 3 Drawing Sheets

EPILATION APPARATUS

FIELD OF THE INVENTION

The invention relates to an epilation apparatus having at least one pair of rotatably mounted epilation rollers, which are arranged in the region of an opening provided in the housing of the apparatus, are rotatingly drivable in opposite directions, cooperate with one another at their periphery and of which one is drivable by a motor, the epilation rollers performing a rotary movement which, in the region of their peripheral cooperation, is directed into the interior of the apparatus, and having a skin protection device which is arranged in the region of the opening to partially cover the epilation rollers and through which the hairs reach the epilation rollers.

BACKGROUND OF THE INVENTION

Such an epilation apparatus is disclosed in FR-PS 2,307,491. In this known epilation apparatus, the skin protection device is formed by a hair screen which has hair-entry slots which have the shape of elongate holes, lie opposite the epilation rollers and, lying adjacent to one another, are arranged extending obliquely to the longitudinal extension of the epilation rollers. It has been found that although such a hair screen is effective in keeping the skin away from the epilation rollers, it presents a relatively severe hindrance to the access of the hairs to the epilation rollers, the hair removal process thereby being made more difficult or hindered and thus also requiring a relatively long time.

An object of the invention is avoiding the difficulties set out above and designing an epilation apparatus of the type referred to above in such a way that good skin protection is achieved by the skin protection device, on the one hand, and good access of the hairs to the epilation rollers through the skin protection device is simultaneously achieved on the other hand. For this purpose, the invention is characterized in that a skin protection device comprising a strip-shaped web of wave-shaped design in relation to the longitudinal extension of the epilation rollers, having wave troughs and wave crests alternately on both sides and being comb-like on both sides is employed in association with the epilation rollers. By virtue of the design of the skin protection device as a wave-shaped, strip-shaped web which is like a comb on both sides and, in accordance with its wave shape, partially covers the epilation rollers, it is guaranteed, due to the tensioning of the skin effected during the passing of the skin protection device over the skin, said procedure being effected transversely to the longitudinal extension of the web in both directions, that the skin cannot reach the epilation rollers through the free areas between the wave-shaped portions of the web. At the same time it is these free areas, however, which permit good access of the hairs to the epilation rollers, this being additionally facilitated by the fact that, due to the wave-shaped design of the web on both sides, a comb effect is obtained in both abovementioned directions of movement, the hair consequently being raised and thus guided particularly effectively to the epilation rollers. In this way, a satisfactory skin protection effect is thus obtained on the one hand, trapping of the skin between the epilation rollers thereby being prevented, and good access of the hairs to the epilation rollers is made possible on the other hand, with the result that the hair removal process, viewed overall, is gentle on the skin, faultless, rapid and safe. As a result also, a low energy consumption for the epilation apparatus is sufficient, this being particularly important when such an epilation apparatus is a battery-operated device.

As seen in a direction transverse to the longitudinal extension of the epilation rollers, the wave-shape of the web can have an overall dimension which is, for example, larger than the sum of the diameters of the epilation rollers covered by the web, but this can be unfavourable as regards the mechanical stability of the web. The abovementioned overall dimension could likewise be chosen to be smaller than the sum of the diameters of the epilation rollers covered by the web, but again this can be unfavourable for the skin protection effect. It has therefore proven advantageous if, as seen transversely to the longitudinal extension of the epilation rollers, the wave-shaped web has an overall dimension which essentially corresponds to the sum of the diameters of the epilation rollers covered by the web. A good compromise as regards a satisfactory skin protection effect on the one hand and a good mechanical stability of the web on the other hand is thereby achieved.

As regards the shaping of the wave-shaped web per se, there are various possibilities. Thus, such a web can, for example, be of essentially sinusoidal, zigzag-shaped or even sawtooth-shaped design. Preferably the wave-shaped web is additionally designed to be wave-shaped in itself. Such a design of the web has a favourable influence on the feeding of the hairs to the epilation rollers since the double wave-shaped web design results in the formation of portions of the web which particularly promote erection of the hairs in the direction of movement of the epilation apparatus over the skin, said direction being transverse to the longitudinal extension of the epilation rollers.

In this context, in a preferred embodiment of the invention, each individual wave-shaped portion of the web is designed to exhibit mirror symmetry relative to a plane of symmetry extending perpendicularly to the longitudinal extension of the epilation rollers. Compared to an embodiment, likewise possible per se, in which the wave-shaped portions of the web each individually extend obliquely relative to the longitudinal extension of the epilation rollers, this is advantageous as regards as simple as possible a design of the web and as good access as possible of the hairs to the epilation rollers in both directions of movement of the epilation apparatus over the skin, said movement being transverse to the longitudinal extension of the web and of the epilation rollers.

In a particularly preferred embodiment, the wave-shaped web is provided, in the region of the cooperation of a pair of epilation rollers with a bead protruding towards the epilation rollers. The hairs raised from the skin by the web are thereby guided particularly close to the region of the cooperation of a pair of epilation rollers in the region of the bead, with the result that the hairs are particularly reliably grasped by the epilation rollers and pulled out of the skin.

The wave-shaped web can, for example, be secured directly by its two ends on the housing of the epilation apparatus. The wave-shaped web could equally well be designed to be of one piece with the housing of the epilation apparatus. It has, however, proven advantageous if two strips, which extend transversely to the longitudinal extension of the epilation rollers, to which strips one end of the web is in each case connected and which have angled ends with which they engage round the housing of the epilation apparatus, are provided for holding the wave-shaped web on the housing of the epilation apparatus. In this way, a clip-like constructional unit is created for the web, which unit can be connected simply and securely to the housing of the epilation apparatus, it also being possible for such a connection to be designed to be releasable. As a result of this, too, the choice of material for the web can be arbitrary in relation to the material chosen for the housing of the epilation apparatus, for example such that the web and the strips connected to it are produced from sheet steel and are thus particularly stable.

It is also preferred that the angled ends of the strips, said ends lying one behind the other as seen in the direction of the longitudinal extension of the epilation rollers, be in each case connected to one another by an additional strip extending in the direction of the longitudinal extension of the epilation rollers. In this way a frame-like support for the web is obtained for the purpose of holding the web on the housing of the epilation apparatus, said support permitting particularly simple and secure and hence stable holding of the web, it also being possible, for example, to design this holding in the form of a releasable snap-in connection. Since the additional strips here extend only in the lateral region of the housing of the epilation apparatus, they do not impair the access of the hairs to the epilation rollers.

It is also preferred in this context that at least one wave-shaped portion of the web is connected to the additional strip adjoining this portion via a holding web extending transversely to the longitudinal extension of the epilation rollers. Additional holding for the web is thereby achieved, this having proven advantageous as regards its mechanical stability.

However, it has also proven advantageous if, for the purpose of holding the wave-shaped web on the housing of the epilation apparatus, two strips extending transversely to the longitudinal extension of the epilation rollers are provided, to which in each case one end of the web is connected and which, on the side facing away from the web, have at least one portion angled sideways with which they engage round the housing of the epilation apparatus. Simple and secure holding of the web on the housing of the epilation apparatus is likewise obtained by this arrangement, it also being possible for this holding to be designed to be releasable.

BRIEF DESCRIPTION OF THE DRAWINGS

The invention is explained in greater detail below with reference to the drawings, in which individual illustrative embodiments of the invention are represented, there being no intention to restrict it to these illustrations however.

DETAILED DESCRIPTION OF THE PREFERRED EMBODIMENTS

Figure 1:
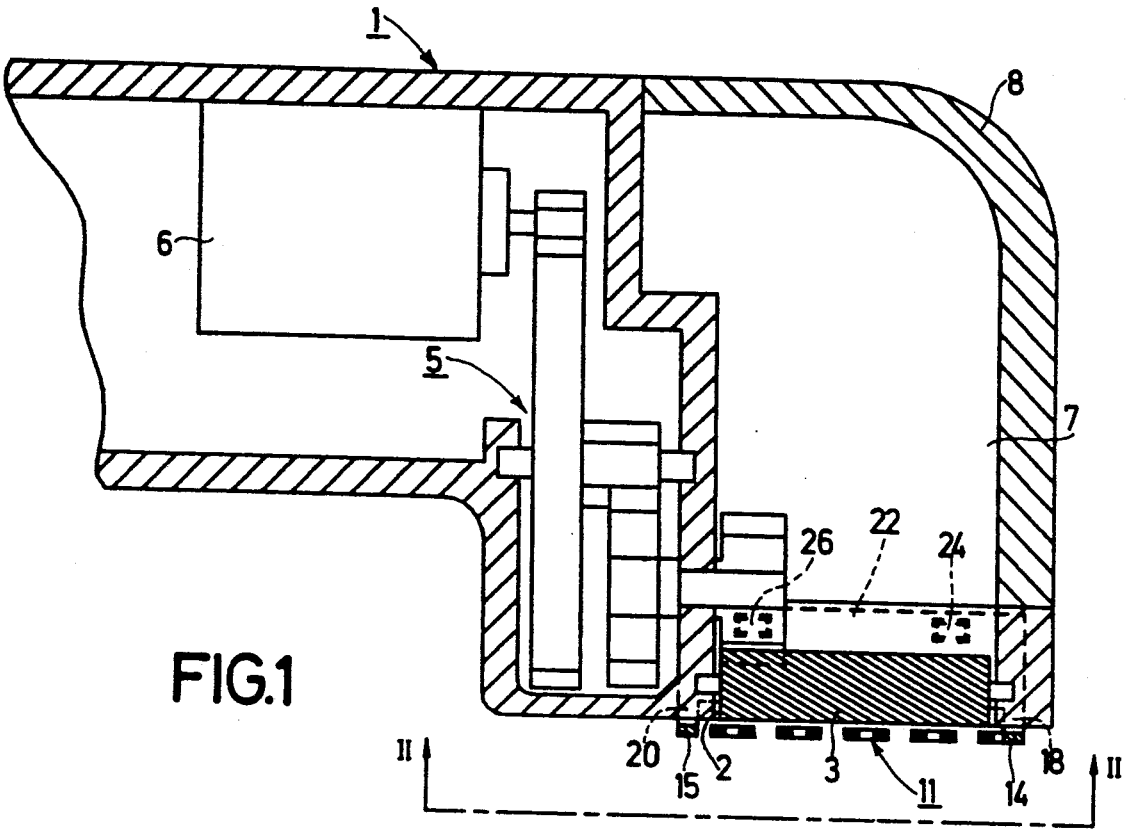
FIG. 1 shows, in a longitudinal section, a portion of an epilation apparatus provided with a skin protection device formed by a wave-shaped, strip-shaped web, which apparatus has a pair of epilation rollers which are rotatingly drivable in opposite directions and cooperate with one another at their periphery, the web being connected at both ends to in each case one strip which extends transversely to the longitudinal extension of the epilation rollers and has angled ends which engage round the housing of the epilation apparatus and of which the angled strip ends, each lying one behind the other as seen in the direction of the longitudinal extension of the epilation rollers, are each connected to one another by an additional strip extending in the direction of the longitudinal extension of the epilation rollers.
Figure 3:
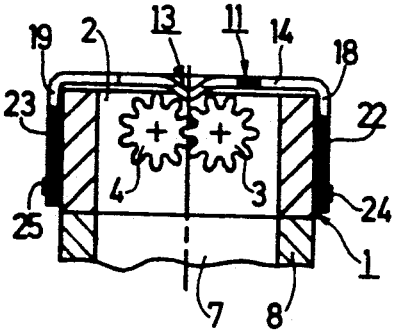
FIG. 3 shows a section through the epilation apparatus taken along line III—III in FIG. 2.
Figure 2:
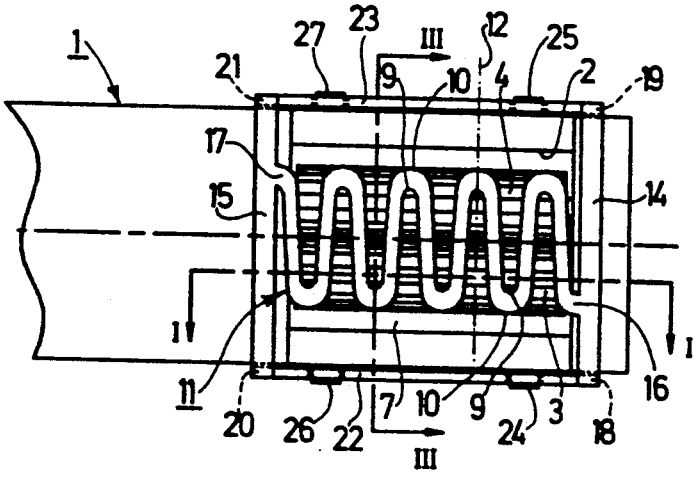
FIG. 2 shows a plan view of the epilation apparatus taken along line II—II in FIG. 1.

In FIGS. 1, 2 and 3, 1 designates the housing of an epilation apparatus which has an opening 2, in the region of which a pair of epilation rollers 3 and 4 are rotatably arranged. The two epilation rollers 3 and 4 here cooperate with one another at their periphery and are rotatingly drivable in opposite directions, the epilation rollers performing a rotary movement which, in the region of their peripheral cooperation, is directed into the interior of the apparatus. In this arrangement, the epilation rollers 3 and 4 can be designed with a smooth periphery or, as envisaged in the present illustrative embodiment, and as can be seen, in particular, from FIG. 3, can have a wave-shaped cross-sectional profile at their periphery, with which they engage in one another in the course of their cooperation. As shown in FIG. 1 for epilation roller 3, one of the two epilation rollers 3 and 4 is drivable, for example via a multistage gear mechanism 5, by a motor 6, the direction of rotation being chosen so that the epilation roller 3 executes a rotary movement which, in the region of its peripheral cooperation with epilation roller 4, is directed into the interior of the apparatus. Due to the peripheral cooperation of epilation roller 3 with epilation roller 4, epilation roller 4 is in turn driven. In this way, the epilation rollers are in a position to grasp a hair protruding between them and exert a tensile force on the latter, with the result that it is pulled out of the skin. A hair removed in this way is then transported on by the epilation rollers into a collecting space 7 of the epilation apparatus, said space adjoining the rollers. For cleaning purposes, this collecting space 7 of the epilation apparatus can be sealed, for example using a cover 8 which can be removed from the apparatus housing 1.

A skin protection device is arranged in the region of the opening 2 in the apparatus and partially covering the epilation rollers 3 and 4, in order to keep the skin away from the epilation rollers so that it is not trapped between the epilation rollers, which would, on the one hand, be painful and, on the other hand, would impair hair removal. However, such a skin protection device must in addition guarantee good access of the hairs to the epilation rollers to ensure that hair removal can be performed effectively. These are two mutually contradicting requirements and are therefore not easy to fulfil simultaneously. In order nevertheless to meet these two requirements, a strip-shaped web 11 of wave-shaped design in relation to the longitudinal extension of the epilation rollers, having wave troughs 9 and wave crests 10 alternately on both sides and being comb-like on both sides is associated with the epilation rollers as a skin protection device. Because of such a wave-shaped and strip-shaped design of the web 11, the skin cannot reach the epilation rollers 3 and 4 directly but relatively large areas of the epilation rollers 3 and 4 which lie between the wave troughs 9 and the wave crests 10 of the strip-shaped web 11 are perfectly accessible, the hairs thus being able to reach the epilation rollers 3 and 4 in these areas without hindrance. The wave troughs 9 and wave crests 10 on both sides of the web 11 form comb teeth on both sides, which extend transversely to the longitudinal extension of the epilation rollers 3 and 4, with the result that when the skin protection device is passed over the skin in both directions transversely to the longitudinal extension of the web 11, good access of the hairs to the epilation rollers is made possible and, in the process, the hairs are furthermore raised by the comb effect and are thus guided particularly effectively to the epilation rollers, tensioning of the skin being simultaneously accomplished, counteracting penetration of the skin into the areas which are free of the web. Thus, in this way, a satisfactory skin protection effect is, on the one hand, obtained and, on the other hand, good access of the hairs to the epilation rollers is made possible.

As regards the shaping of the wave-shaped and strip-shaped web per se, there are a number of possibilities. As can be seen from FIG. 2, in the present illustrative embodiment those portions of the web 11 which are situated between the wave troughs 9 and the wave crests 10 are designed essentially as strips of rectilinear extension which merge into rounded tips which form the wave crests and wave troughs respectively. However, the web could equally well also be of zigzag-shaped or sinusoidal design. In the present illustrative embodiment, as seen transversely to the longitudinal extension of the epilation rollers 3 and 4, the wave-shaped web 11 has an overall dimension which essentially corresponds to the sum of the diameters of the epilation rollers 3 and 4 covered by the web 11, with the result that the epilation rollers are essentially completely covered. A good compromise with regard to a satisfactory skin protection effect on the one hand and a good mechanical stability of the web on the other hand is thus achieved. Furthermore, it is envisaged in the present illustrative embodiment that each individual wave-shaped portion of the web 11 is designed to exhibit mirror symmetry relative to a plane 12 of symmetry extending perpendicularly to the longitudinal extension of the epilation rollers 3 and 4, of which planes of symmetry only one is drawn in FIG. 2. As a result, a very simple design of the web is obtained and good feeding of the hairs to the epilation rollers in both directions of movement of the epilation apparatus over the skin, said directions of movement being transverse to the longitudinal extension of the web, is thus achieved. However, it is possible to design the mutually adjacent wave-shaped portions of the web so that, for example, they run obliquely relative to the longitudinal extension of the epilation rollers, i.e. to give the web a wave shape which extends obliquely to its longitudinal extension.

As can be seen from FIG. 3, in the present illustrative embodiment the wave-shaped web 11 is provided in the region of the cooperation of the epilation rollers 3 and 4 with a bead 13 protruding towards the epilation rollers. As a result, in the region of the bead 13 the hairs raised from the skin by the web 11 are guided particularly close to the region of the cooperation of the epilation rollers, the hairs thus being grasped particularly securely by the epilation rollers and pulled out of the skin.

There are likewise a number of possibilities for holding or attaching the web onto the epilation apparatus. Thus, for example, the web can be secured directly by its two ends on the housing of the epilation apparatus or it may be designed to be directly of one piece with the housing of the epilation apparatus. In the present illustrative embodiment, two strips 14 and 15 extending transversely to the longitudinal extension of the epilation rollers 3 and 4 are provided for holding the web 11 on the housing 1 of the epilation apparatus, to which strips one end 16 or 17 of the web 11 is in each case connected. The strips 14 and 15 here have angled ends 18, 19 and 20, 21 respectively, with which they engage like clips round the housing 1 of the epilation apparatus. It is furthermore envisaged in the present illustrative embodiment that the angled ends 18, 20 and 19, 21, respectively, of the two strips 14 and 15, said ends lying one behind the other as seen in the direction of the longitudinal extension of the epilation rollers 3 and 4, are in each case connected to one another by an additional strip 22 or 23 extending in the direction of the longitudinal extension of the epilation rollers 3 and 4. In this way, a frame-like support for the web 11, formed by the strips 14 and 15 and the additional strips 22 and 23, is obtained for holding the web 11 on the housing 1 of the epilation apparatus. The said support permits simple and secure and thus stable holding of the web, not only the angled ends 18, 19 and 20, 21 of the two strips 14 and 15 but also the additional strips 22 and 23 engaging round the housing 1 of the epilation apparatus without the additional strips 22 and 23 impairing the access of the hair to the epilation rollers 3 and 4, since they extend only in the lateral region of the housing 1 of the epilation apparatus. In the present case, the web 11, the strips 14 and 15 and the additional strips 22 and 23 can, for example, be produced from a piece of sheet steel, these parts, considered overall, thus having a good mechanical stability. The cross-section of the strip-shaped web 11 produces a rectangle, as can be discerned from FIGS. 1 and 3. If desired, the outer edges of the cross-sectional profile of the web which are situated on the skin side can also be rounded. In principle, it would of course also be possible to provide the web with a different cross-sectional profile, such as, for example, a semicircular cross-sectional profile. It is preferred that the skin protection device formed by the web 11 be connected releasably to the housing 1 of the epilation apparatus in order, for example, to permit the web 11 itself or the epilation rollers 3 and 4 to be cleaned easily. There are various possibilities for such a releasable connection within the framework of the prior art known for this purpose. In the present illustrative embodiment, four lugs 24, 25, 26 and 27 are provided for this purpose on the housing 1 of the epilation apparatus, said lugs snapping into corresponding openings in the additional strips 22 and 23. Alternatively projections may be provided on the additional strips 22 and 23, which engage in corresponding depressions on the housing 1 of the epilation apparatus.

Figure 4:
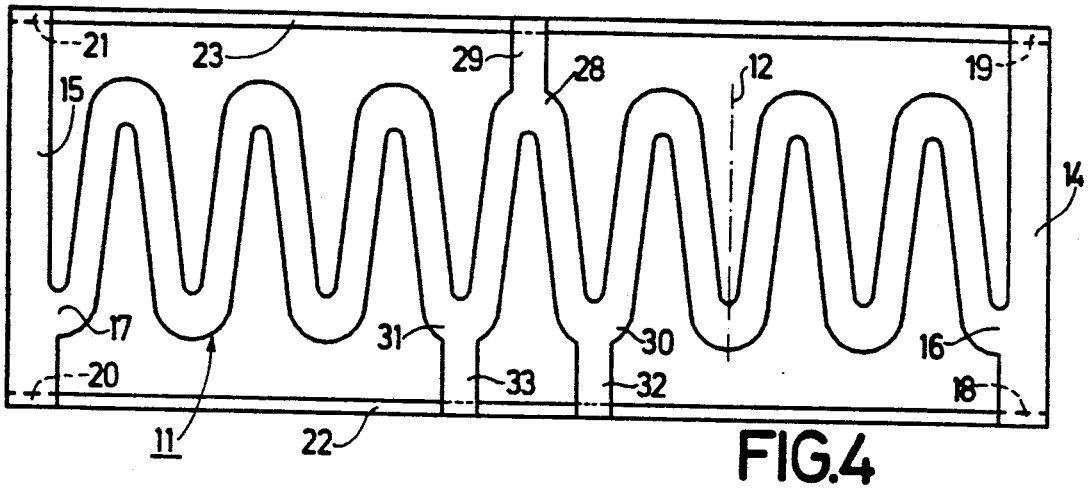
FIG. 4 shows, in isolation, in plan view and in the mode of representation of FIG. 2, a modification of the skin protection device used in the illustrative embodiment according to FIGS. 1 to 3, in which the three wave-shaped portions of the web are connected to the additional strip adjoining the respective portion in each case via a holding web extending transversely to the longitudinal extension of the epilation rollers.

In the illustrative embodiment shown in FIG. 4, which concerns a modification of the skin protection device used in the illustrative embodiment according to FIGS. 1 to 3, provision is additionally made for some of the wave-shaped portions of the web 11 to be connected to the additional strip 22 or 23 adjoining these portions via a holding web extending transversely to the longitudinal extension of the epilation rollers. Accordingly, the wave-shaped portion of the web 11 designated 28 is connected to the additional strip 23 adjoining this portion via a holding web 29 extending transversely to the longitudinal extension of the epilation rollers 3 and 4. In addition, the wave-shaped portions 30 and 31 of the web 11 are connected in corresponding fashion to the additional strip 22 adjoining these portions via holding webs 32 and 33 respectively. Additional holding for the web 11 is thereby achieved, this having proven advantageous with regard to its mechanical stability. It is also possible, for example, to connect only one wave-shaped portion of the web to the additional strip adjoining it via a holding web.

Figure 5:
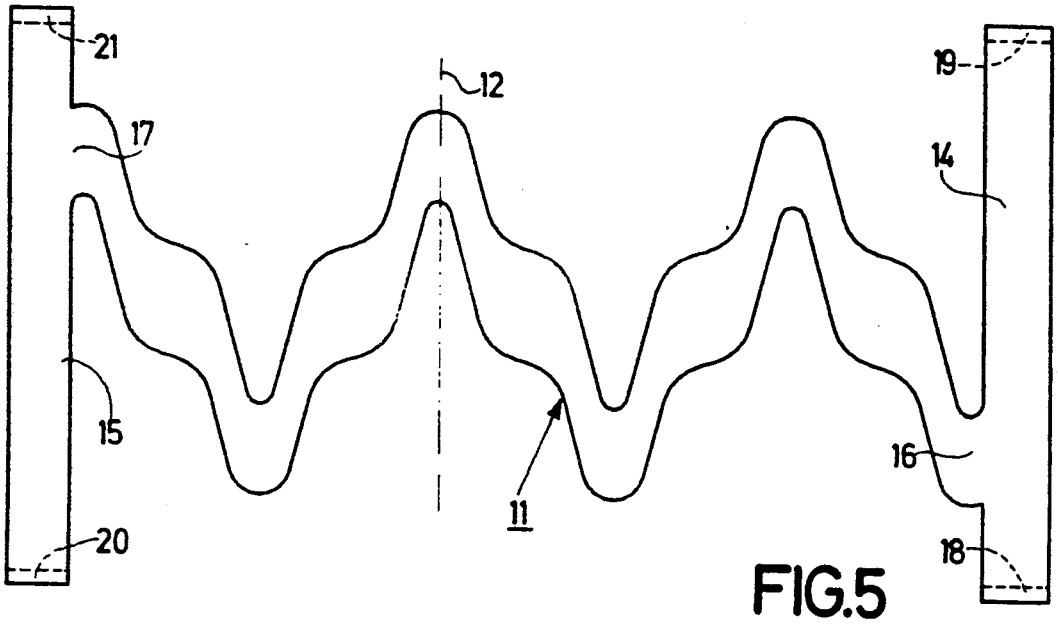
FIG. 5 shows, in the mode of representation of FIG. 4, a skin protection device in which the wave-shaped web is additionally designed to be wave-shaped in itself.

FIG. 5 shows a skin protection device in which the wave-shaped, strip-shaped web 11 is additionally designed to be wave-shaped in itself, as can be discerned from a side view of the configuration of the web. Such a design of the web 11 has a favourable influence on the feeding of the hairs to the epilation rollers since, due to the double wave-shaped web design, portions of the web are formed which particularly promote erection of the hairs in the direction of movement of the epilation apparatus over the skin, said movement occurring transversely to the longitudinal extension of the epilation rollers. Here too, two strips 14 and 15 extending transversely to the longitudinal extension of the epilation rollers are provided for holding the web 11 on the housing of the epilation apparatus, one end 16 or 17 of the web 11 being connected in each case to said strips, the strips 14 and 15 again having angled ends 18, 19 and 20, 21 respectively, with which they can engage like clips round the housing of the epilation apparatus.

Figure 6:
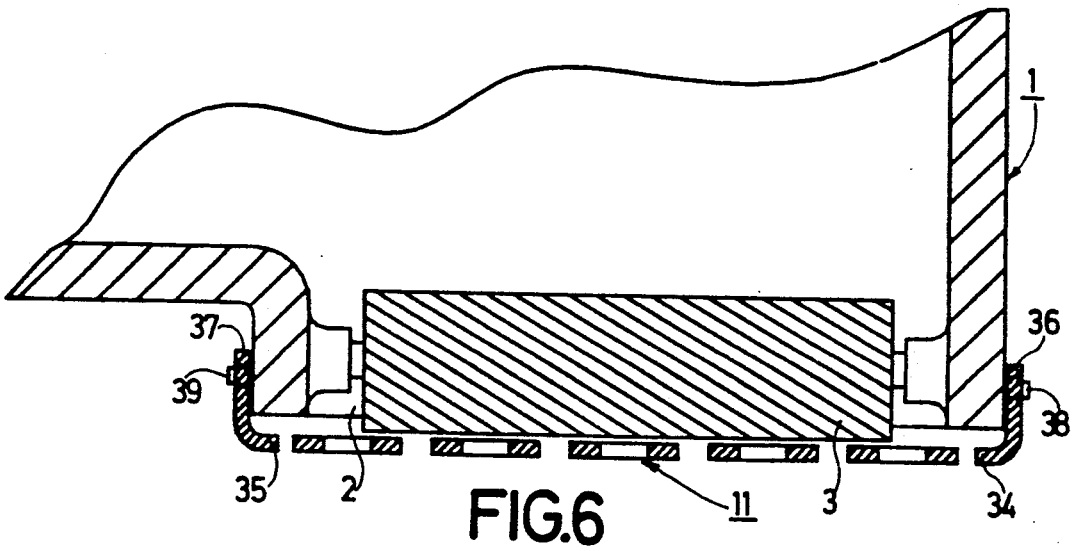
FIG. 6 shows, in the mode of representation of FIG. 1, a portion of an epilation apparatus in which the wave-shaped web forming the skin protection device is connected by both ends to in each case one strip which extends transversely to the longitudinal extension of the epilation rollers and, on the side facing away from the web, has a portion angled sideways, with which it engages round the housing of the epilation apparatus.

For holding the wave-shaped web 11 forming the skin protection device on the housing 1 of the epilation apparatus in the case of the epilation apparatus shown in FIG. 6, it is likewise envisaged that each of the ends of the web 11 is connected to a strip 34 or 35 extending transversely to the longitudinal extension of the epilation rollers, but, on the side facing away from the web 11 each of these strips has a portion 36 or 37 angled sideways, with which they engage round the housing 1 of the epilation apparatus. By means of journals 38 and 39 which are provided on the housing 1 and engage in correspondingly arranged holes in the sideways-angled portions 36 and 37 of the strips 34 and 35 respectively, releasable holding of the web 11 on the housing 1 of the epilation apparatus is also provided.

Figure 7:
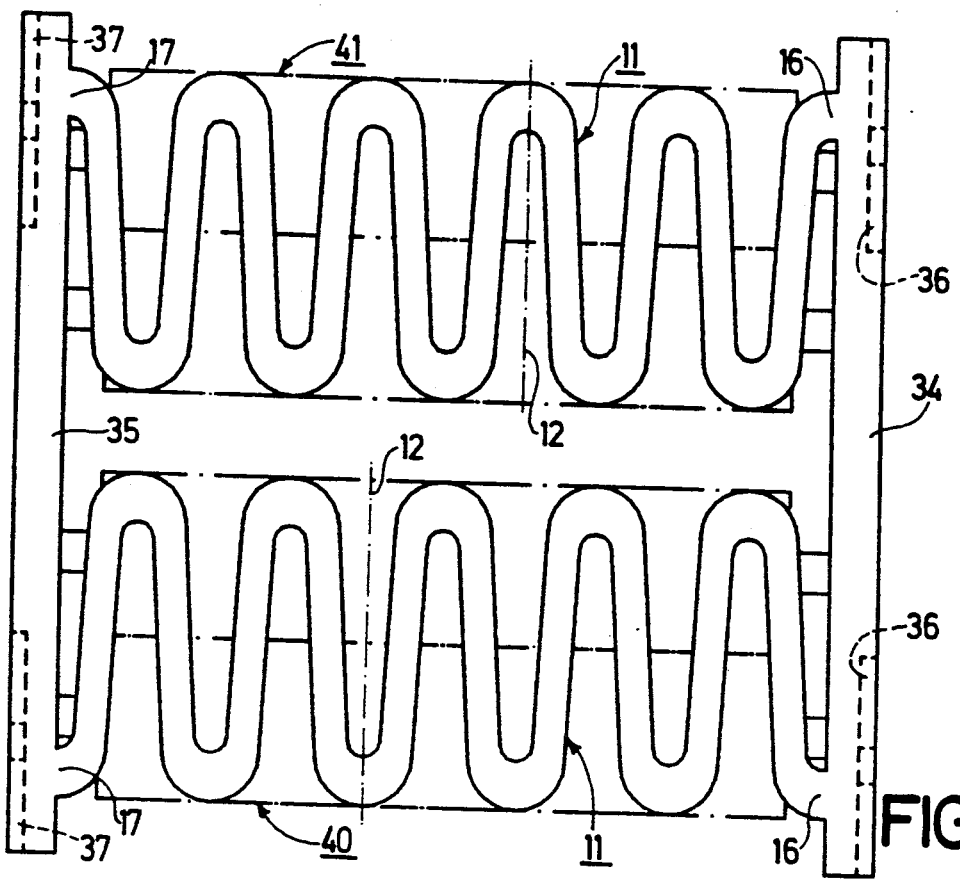
FIG. 7 shows, in the mode of representation of FIG. 4, and in isolation, a skin protection device suitable for use in an epilation apparatus according to FIG. 6, it being assumed that the epilation apparatus has two pairs of epilation rollers, here indicated schematically by chain lines, which are situated at a distance from one another and to each of which is allocated a wave-shaped web, the ends of the webs being connected, in pairs, in each case to a strip which extends transversely to the longitudinal extension of the epilation rollers and which in each case has two portions angled sideways for gripping the housing of the epilation apparatus.

The skin protection device shown in FIG. 7 is suitable for use in an epilation apparatus in accordance with the illustrative embodiment according to FIG. 6 In this embodiment the epilation apparatus should have two pairs of epilation rollers situated at a distance from one another, as indicated by chain lines, one pair of epilation rollers being designated 40 and the other pair of epilation rollers being designated 41. As a skin protection device, each pair 40 or 41 of the epilation rollers has its own wave-shaped, strip-shaped web 11, the overall dimension of which, as seen transversely to the longitudinal extension of the epilation rollers of each pair, corresponds essentially to the sum of the diameters of the epilation rollers of each pair covered by the respective web. To hold these two webs 11 on the housing of the epilation apparatus, their ends 16 and 17 are connected to two strips 34 and 35, respectively, which extend transversely to the longitudinal extension of the epilation rollers and, on the side facing away from the webs 11, each have two portions 36 and 37 respectively angled sideways, with which they can engage round the housing of the epilation apparatus. Simple and secure holding of the two webs 11, associated with each pair 40 and 41 of epilation rollers, on the housing of the epilation apparatus is thus obtained.

Figure 8:
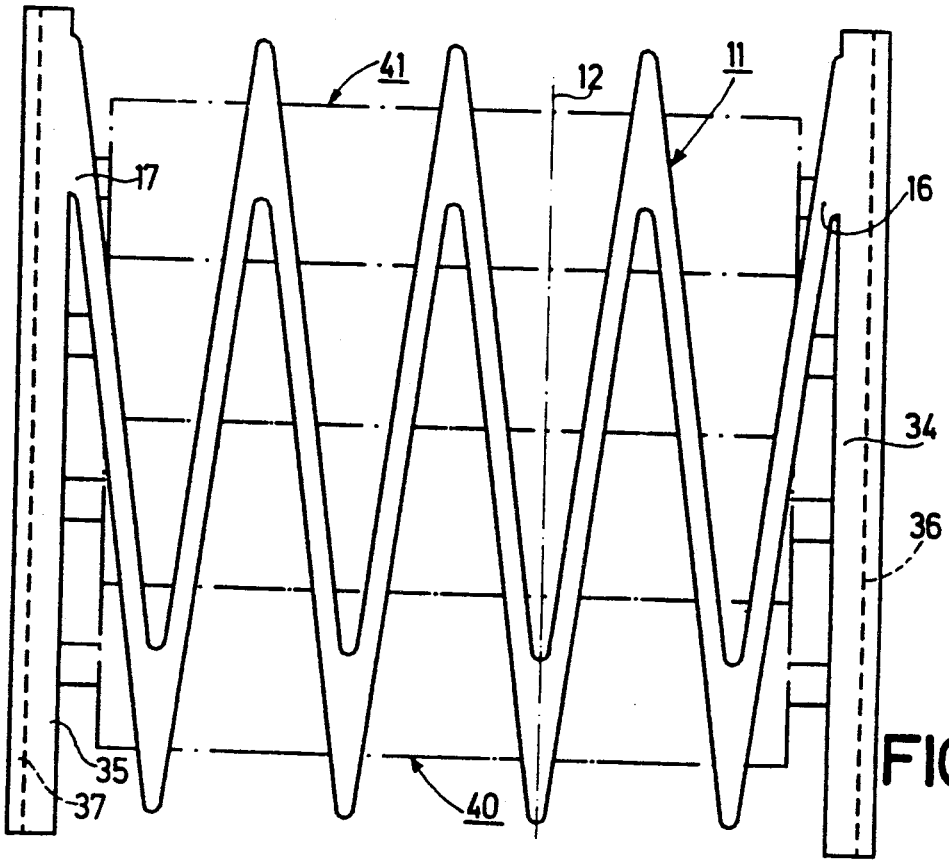
FIG. 8 shows, likewise in the mode of representation of FIG. 4 and in isolation, a skin protection device suitable for use in an epilation apparatus according to FIG. 6, it being assumed that the epilation apparatus has two pairs of epilation rollers, here indicated schematically by chain lines, which cooperate in succession with one another at their periphery and to all of which jointly a single wave-shaped, here zigzag-shaped web is allocated, the overall dimension of which, as seen transversely to the longitudinal extension of the epilation rollers, is greater than the sum of the diameters of the epilation rollers.

The skin protection device shown in FIG. 8 is likewise suitable for an epilation apparatus in accordance with the illustrative embodiment according to FIG. 6, but in this embodiment the epilation apparatus should have two pairs of epilation rollers which cooperate in succession with one another at their periphery. These two pairs of epilation rollers are again designated by 40 and 41 and indicated schematically by chain lines. As can be seen, the two central epilation rollers cooperate with one another at their periphery, only one of the four epilation rollers then being driven by the motor of the epilation apparatus. In this embodiment, the skin protection device comprises an essentially zigzag-shaped, wave-shaped, strip-shaped web 11, which is attached jointly to the two pairs 40 and 41 of epilation rollers, having an overall dimension as seen transversely to the longitudinal extension of the epilation rollers which is greater, for example, than the sum of the diameters of the four epilation rollers covered by the web 11. For the purpose of holding the web 11 on the housing of the epilation apparatus, its two ends 16 and 17 are connected in each case to a strip 34 or 35 respectively, which extends transversely to the longitudinal extension of the epilation rollers and, on the side facing away from the web 11, in each case has a portion 36 or 37 which is angled sideways and with which they can engage round the housing of the epilation apparatus.

As can be seen from the details given above, above-described illustrative embodiments may be modified without exceeding the bounds of the invention. This is particularly true as regards the shaping of the wave-shaped and strip-shaped web forming the skin protection device and its retention on or connection to the housing of the epilation apparatus.

We claim:

1. An epilation apparatus having a housing to which there is attached at least one pair of rotatably mounted epilation rollers, which are arranged in the region of an opening provided in the housing of the apparatus, are rotatingly drivable in opposite directions, cooperate with one another at their periphery and of which one is drivable by a motor, the epilation rollers performing a rotary movement which, in the region of their peripheral cooperation, is directed into the interior of the apparatus; said apparatus also having a skin protection device which is arranged in the region of the opening to partially cover the epilation rollers and through which the hairs reach the epilation rollers, said skin-protecting device comprising a strip-shaped web comprising at least two sides having portions of wave-shaped design in relation to the longitudinal extension of the epilation rollers, said web having wave troughs and wave crests alternately on both sides and being comb-like on both sides.

2. An epilation apparatus according to claim 1, wherein as seen transversely to the longitudinal extension of the epilation rollers, the wave-shaped web has an overall dimension which essentially corresponds to the sum of the diameters of the epilation rollers covered by the web.

3. An epilation apparatus according to claim 1, wherein each wave-shaped portion of the web is designed to exhibit mirror symmetry relative to a plane of symmetry extending perpendicularly to the longitudinal extension of the epilation rollers.

4. An epilation apparatus according to claim 1 wherein the wave-shaped web is provided in the region of the cooperation of the epilation rollers of a pair of epilation rollers with a bead protruding towards the epilation rollers.

5. An epilation apparatus according to claim 1 wherein two strips, which extend transversely to the longitudinal extension of the epilation rollers, to which strips an end of the web is in each case connected and which have angled ends with which they engage round the housing of the epilation apparatus, are provided for holding the wave-shaped web on the housing of the epilation apparatus.

6. An epilation apparatus according to claim 5, wherein the angled ends of the strips, said ends lying one behind the other as seen in the direction of the longitudinal extension of the epilation rollers, are in each case connected to one another by an additional strip extending in the direction of the longitudinal extension of the epilation rollers.

7. An epilation apparatus according to claim 6, wherein at least one wave-shaped portion of the web is connected to the additional strip adjoining this portion via a holding web extending transversely to the longitudinal extension of the epilation rollers.

8. An epilation apparatus according to claim 1, wherein for the purpose of holding the wave-shaped web on the housing of the epilation apparatus, two strips extending transversely to the longitudinal extension of the epilation rollers are provided, to which in each case an end of the web is connected and which, on a side facing away from the web, have at least one portion angled sideways with which they engage round the housing of the epilation apparatus.

9. An epilation apparatus according to claim 1, wherein the strip-shaped web has a double wave-shaped design in relation to the longitudinal extension of the depilation rollers; said web having double wave troughs and double wave crests alternately on both sides.

* * * * *